US008185982B1

(12) United States Patent
Lizama et al.

(10) Patent No.: US 8,185,982 B1
(45) Date of Patent: May 29, 2012

(54) INTEGRATED SHOWERING AND BODY SUPPORT SYSTEM

(75) Inventors: Mauricio A Lizama, San Juan, PR (US); Gustavo E Frank-Ayala, San Juan, PR (US); Nestor M Martinez, San Juan, PR (US); Jose J Mayi, San Juan, PR (US); David Serrano, San Juan, PR (US)

(73) Assignee: University of Puerto Rico, San Juan, PR (US)

( * ) Notice: Subject to any disclaimer, the term of this patent is extended or adjusted under 35 U.S.C. 154(b) by 548 days.

(21) Appl. No.: 12/325,101

(22) Filed: Nov. 28, 2008

Related U.S. Application Data

(60) Provisional application No. 61/004,497, filed on Nov. 28, 2007.

(51) Int. Cl.
*A47K 3/28* (2006.01)

(52) U.S. Cl. ..... 4/615; 4/601; 4/567; 297/180.15

(58) Field of Classification Search ..... 4/615, 596, 4/601, 604, 612, 567–570, 571.1, 573.1, 4/602, 603; 297/180.15
See application file for complete search history.

(56) References Cited

U.S. PATENT DOCUMENTS 2,602,697 A * 7/1952 Otto et al. ..... 422/282
3,040,335 A * 6/1962 Gellmann ..... 4/570
3,121,235 A * 2/1964 Gellmann ..... 4/570
3,231,200 A * 1/1966 Heald ..... 239/318
3,662,409 A * 5/1972 Johansson ..... 4/560.1
3,971,074 A * 7/1976 Yxfeldt ..... 4/570
4,099,672 A * 7/1978 Sheahan et al. ..... 239/317
4,121,773 A * 10/1978 Headen et al. ..... 239/317
4,123,808 A * 11/1978 Guarrera ..... 4/447
4,150,445 A * 4/1979 Bailey ..... 4/546
4,397,050 A * 8/1983 Davis et al. ..... 4/601
4,682,728 A * 7/1987 Oudenhoven et al. ..... 236/12.12
4,756,030 A * 7/1988 Juliver ..... 4/668
5,063,621 A * 11/1991 Sellars ..... 4/568
6,550,080 B1 * 4/2003 Grewal ..... 4/662
6,842,919 B2 * 1/2005 Wilson et al. ..... 4/578.1
2002/0040500 A1 * 4/2002 Noguchi et al. ..... 4/596

* cited by examiner

*Primary Examiner* — Robert Canfield
*Assistant Examiner* — Babajide Demuren
(74) *Attorney, Agent, or Firm* — Hoglund & Pamias, PSC; Roberto J. Rios

(57) ABSTRACT

A bathing chair which has a water-spraying function for simultaneously effecting a shower discharge from each of a plurality of shower discharge ends and thus assist a person with severe disabilities while cleansing him or herself or while being assisted by a third person. The bathing chair including strategically located nozzles to wash critical body parts, a main control system with manual and electro-mechanical operated valves, two main flow paths with independent control systems, means for combining a soap product and water, a water temperature sensor, and a pump/reservoir system for water pressure adjustment.

5 Claims, 5 Drawing Sheets

INTEGRATED SHOWERING AND BODY SUPPORT SYSTEM

FIELD OF THE INVENTION

The present invention generally relates to a bathing apparatus. More specifically, the present invention relates to a bathing chair which has a water-spraying function for simultaneously effecting a shower discharge from each of a plurality of shower discharge ends and thus assist a person with severe disabilities while cleansing him or herself or while being assisted by a third person.

BACKGROUND OF THE INVENTION

Conventional single nozzle showers and bath chairs or benches cannot offer an effective and high quality bath experience to people with severe physical disabilities. People with severe disabilities often require assistance to operate the shower, to use a soap and lather, and to complete other functions such as: washing critical body areas, rinsing lather and body support because of no movement capability on their lower extremities and limited or no movement capability on their upper extremities. These functions are particularly difficult in homes where trained personnel is not available, and it is often difficult in hospitals, rest homes and the like even when trained people are available; due to bath area space and personnel schedule constraints. In addition to this, there are many people living in their own homes who find it difficult to bath, and are reluctant or cannot afford to have some assistance.

Some attempts have been made in the past to fill this need, but they have not been very successful. Some units are constructed so that water nozzles are collocated too distant from critical body areas, most cannot be controlled from within the chair or bench so that a person usually requires assistance when bathing, and none of which the applicant is aware provides the user against variation of pressure and temperature of the water during use. It is well known in the art, that the pressure of the water may be adjusted at the beginning of a shower, however the pressure of the water supply may drop either as the result of the supply running out, or of others turning the cold water taps and hot water taps on and off in the same water system. For example, often a person who requires assistance to move is left by him or herself, a serious change in the water pressure or temperature can take place before the caretaker or assistance returns and the person who requires assistance will need to wait for assistance to perform adjustments. The disabled person is not only exposed to emotionally stressful situations due to feelings of impotence or helplessness, but to dangerous physical situations such as burns caused by hot water. Further, a disable person may feel uncomfortable when exposing his or her private parts for proper cleansing of those areas.

As such, there is a need for an integrated showering and body support system that provides greater independence to individuals having limited or severely constrained mobility. More particularly, there is a need for an integrated showering and body support system designed to provide an effective bathing experience to people with severe physical disabilities.

SUMMARY OF THE INVENTION

It is, therefore, an object of the present invention to provide a system which is devoid of the above-described defects of the conventional bath chair or bench for people with severe physical disabilities.

The present invention comprises an integrated showering and body support system which has a water-spraying function for simultaneously effecting a shower discharge from each of a plurality of shower discharge ends and thus assist a person with severe disabilities while cleansing him or herself or while being assisted by a third person. The integrated showering and body support system including strategically located nozzles to wash critical body parts, a main control system with manual and electro-mechanical operated valves, two main flow paths with independent control systems, means for combining a soap product and water, a water temperature sensor, and a pump/reservoir system for water pressure adjustment.

The primary object of the present invention is to provide an integrated showering and body support system which can be easily and quickly attached to or detached from existing shower installations and specifically includes a flow system with adjustable nozzles to enable the unit of the present invention to be orientated in the optimum position for the particular individual or individuals employing the device. The present invention generally includes polyvinyl chloride pipes attached via removable straps means to a corrosion resistant aluminum frame. The polyvinyl chloride pipes are disposed in an enveloping fashion in relation to the aluminum frame. The system is easy to install in existing showers and may be designed as a modular system; thereby providing an extremely neat and attractive installation which can be installed without requiring the services of a professional plumber. An important feature of the present is its extreme simplicity of construction, neatness in appearance, effectiveness in operation, adaptation to various installations and users and its generally inexpensive manufacturing and installation costs.

Another object of the present invention is to provide a flow system unit having a plurality of evenly distributed low flow shower heads thereon which are individually adjustable and selectively operable for enabling discharge of a shower spray or sprays at different elevations and in different angular directions for enabling substantially the entire surface area of a person's body to be effectively engaged by a shower spray thereby facilitating the more effective cleansing of the body and also enabling the shower sprays to target specific areas of the body (e.g. chest, back, arms, legs and face) due to the direct engagement or contact of the shower spray water with the various surface areas of the body.

A further object of the present invention is to provide an integrated showering and body support system incorporating a main control system and a soap mixing device. The main control system of the present invention allows manual and remote control of the overall system and the facial water flow. The control system is placed outside integrated showering and body support system and it is compact enough to fit inside in a bathroom shower and still allow comfortable movement of the person using the integrated showering and body support system. The soap mixing device incorporates a soap reservoir that will provide a person with soap for one cycle. An initial soap solution is sprayed over a person's body for a more thorough washing experience.

Still another feature of the present invention is the provision of an integrated showering and body support system having a pump/water reservoir system to make up for any loss water pressure along the flow system. This feature is ideal for boosting low water pressure in homes where the incoming municipal water supply pressure is inadequate and provides with a strong, even water pressure that will provide the disabled person with a more pleasurable and efficient washing process. Still another very important feature of the present invention is the provision of an integrated showering and body support system which is highly utilitarian and is capable of reducing a disabled person's dependency on assistant personnel. The system includes features that will allow a more independent interaction between the device and the user.

BRIEF DESCRIPTION OF THE DRAWINGS

Further features and advantages of the invention will become apparent from the following detailed description taken in conjunction with the accompany figure showing illustrative embodiments of the invention, in which.

Throughout the figure, the same reference numbers and characters, unless otherwise stated, are used to denote like elements, components, portions or features of the illustrated embodiment. The subject invention will be described in detail in conjunction with the accompany figure, in view of the illustrative embodiment.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. It is clear that changes and modifications to the described embodiment can be made without departing from the scope and spirit of the present invention as defined by the appended claims.

Figure 6:
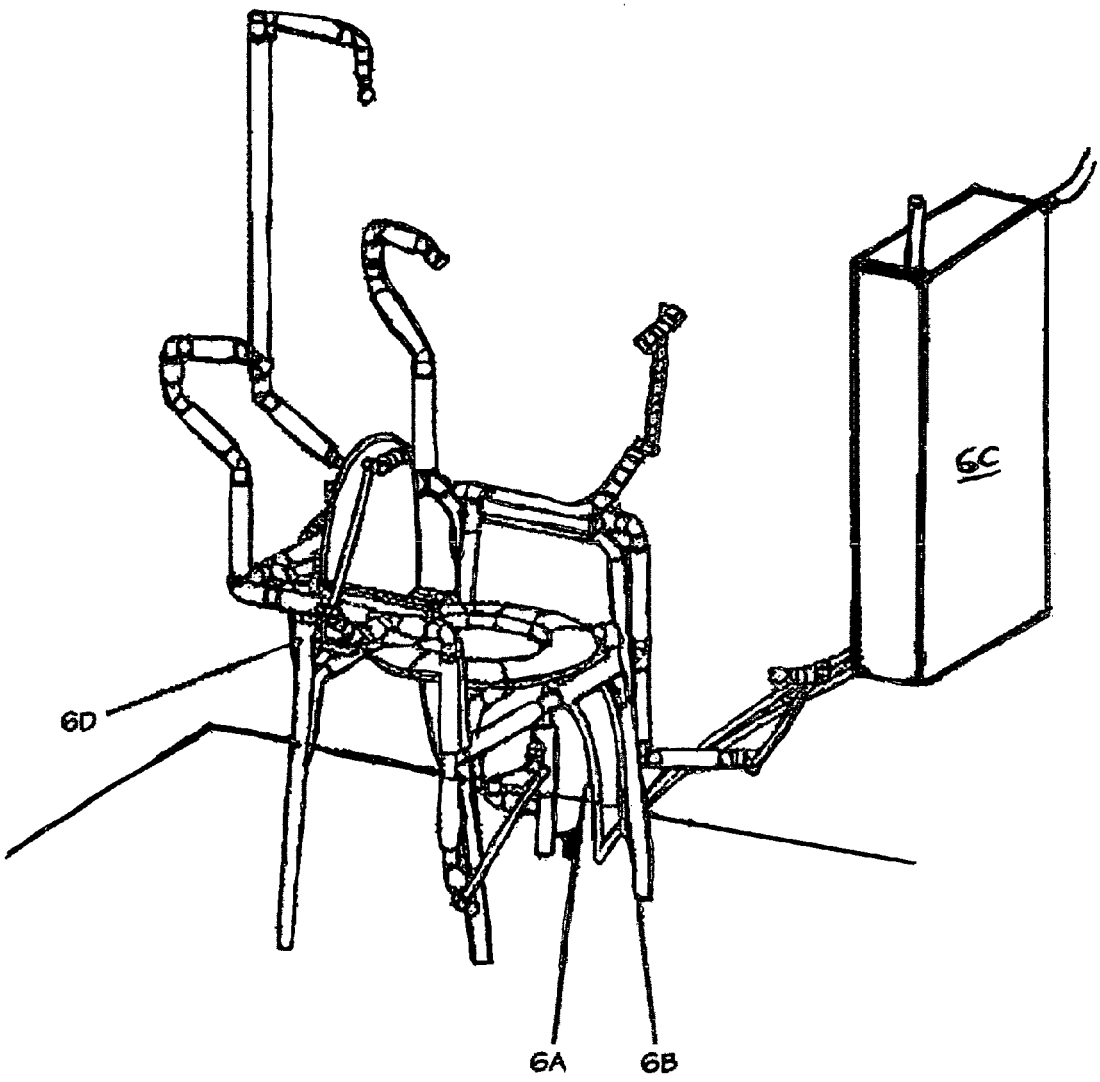
FIG. 6 shows the integrated showering and body support system as connected to the main control system according to a preferred embodiment of invention.

Referring now specifically to the drawings, the numeral 1 generally designates the integrated showering and body support system of the present invention which is connected to an existing main pipe as will be shown in more detail in FIG. 6. The piping system 1C is connected to existing plumbing via the main control system and it is attached to a corrosion resistant aluminum frame 1E that offers body support to the user. The piping system 1C is composed of polyvinyl chloride pipes and it is installed to the aluminum frame 1E using removable plastic straps that may be removed for readjustment and/or maintenance. The piping system 1C was substantially covered with foam isolation to protect it from impact loading. Further, the foam isolation offers a tighter strapping and thus, better structural integrity. The aforementioned foam isolation will substantially cover, for example, polyvinyl chloride pipe 1F. The outer end of the piping system 1C extends upwardly as indicated by 1A and is provided with a facial flow shower head which may be adjusted with a main control system for controlling the characteristics of the spray discharged by the shower head and also for completely closing off the shower head is if desired.

Adjustable metal arm 1B provides the user with extra support for leaning low or non mobility extremities or with means to support the user's body while seating down or standing from the body support system. Further, the adjustable metal arms allows for versatility, customization and mobility. If required and appropriate, suitable water temperature sensor for hot and cold water will be provided for controlling the temperature of the water discharged from the shower heads.

If the integrated showering and body support system is installed in a conventional bathtub, there will be the normally provided drain valve 1D for discharging water into the bathtub in a conventional manner. The drain valve 1D allows proper maintenance by providing the user with means to drain all the accumulated used water and avoid deterioration of the system. This represents conventional construction and the present invention may be installed in any bathtub assembly or shower bath assembly.

Disposed along the length of the piping system 1C, there is a plurality of corporal low flow shower heads 1G which are identical in functionality to the facial flow shower head 1A. The use of the low flow shower heads requires little water pressure and in some cases the water flow pressure may be adjusted with the use of a pump/water reservoir system (not shown). The system has a total of seven corporal low flow shower heads that distribute the water flow all around the user. Additionally, a nozzle is included beneath the body support system so as to reach the genital/perianal area; the bidet-like function of the aforementioned nozzle will provide a more efficient cleaning of that critical body area. The uppermost shower head 1A is mounted on a downturned end arm portion of the polyvinyl chloride pipe 1F and the shower heads 1G are disposed in horizontally-spaced relation from each other and in a vertically-spaced relation from facial flow shower head 1A. The shower heads 1A and 1G are each divided into two secondary flows: a corporal water show and a facial water show. The facial flow shower head has an independent control that gives the user independence about the bath experience.

Figure 1:
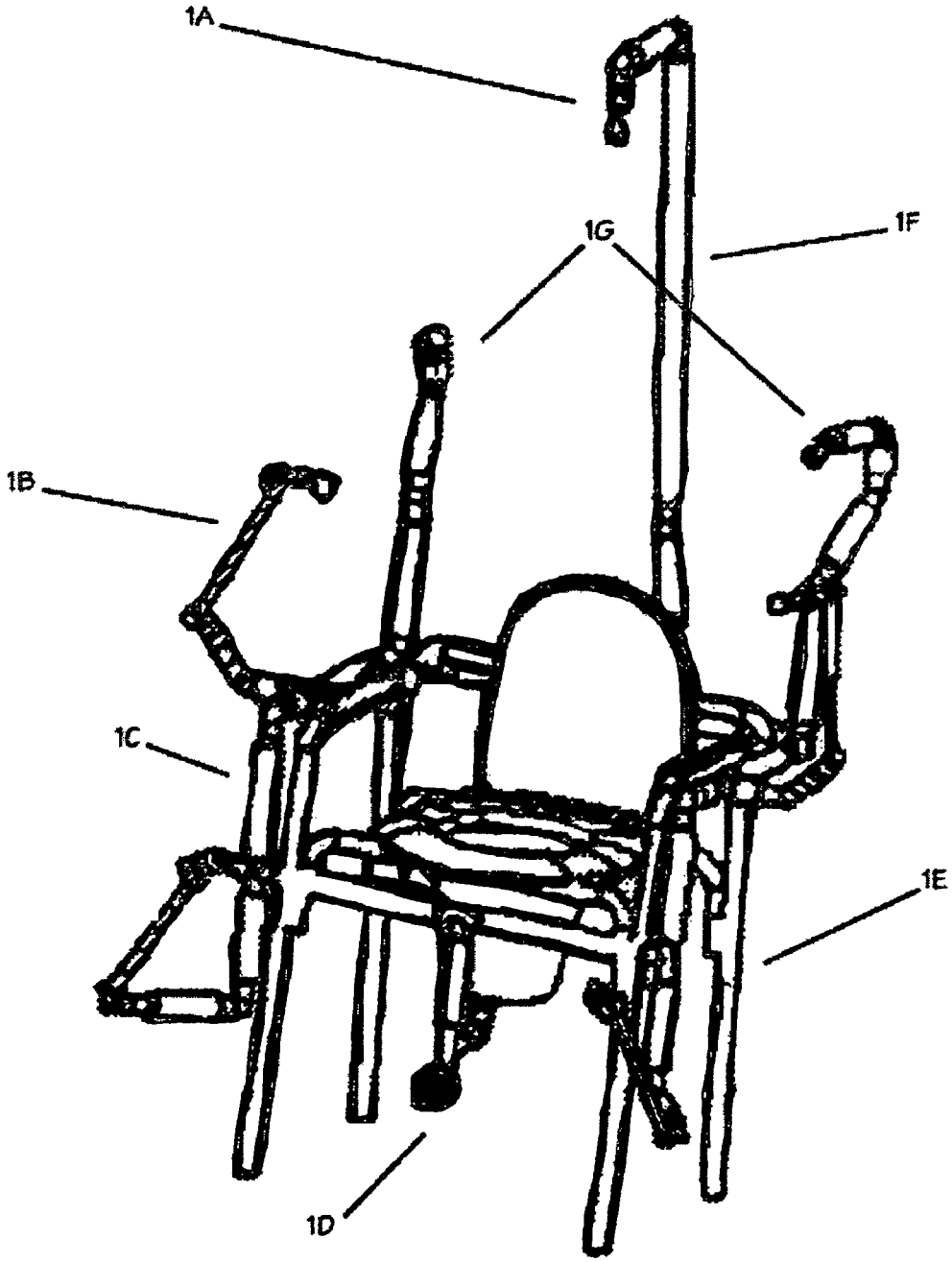
FIG. 1 shows an integrated showering and body support system according to a preferred embodiment of invention.
Figure 2:
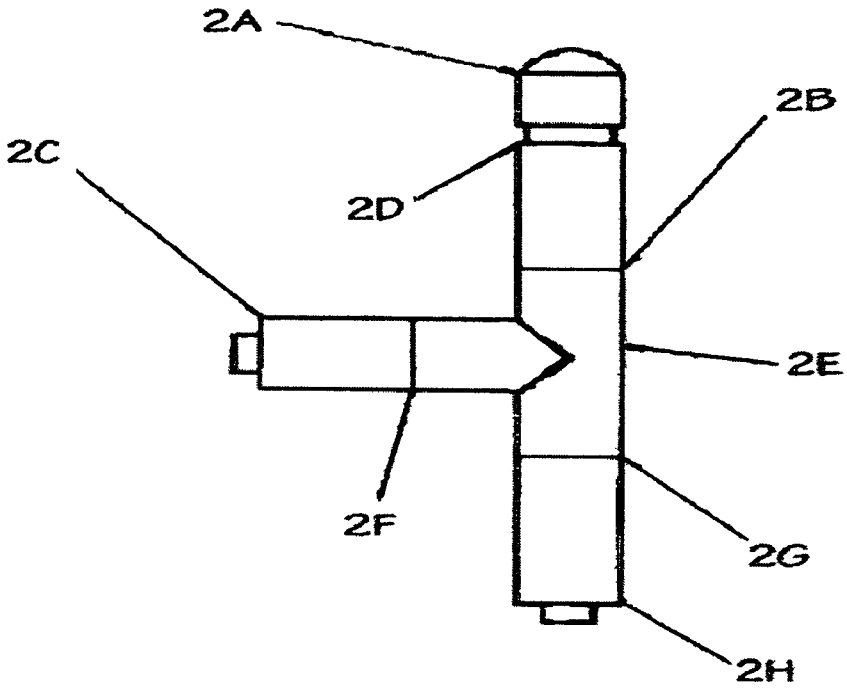
FIG. 2 shows a soap mixing piping system according to a preferred embodiment of invention.
Figure 3:
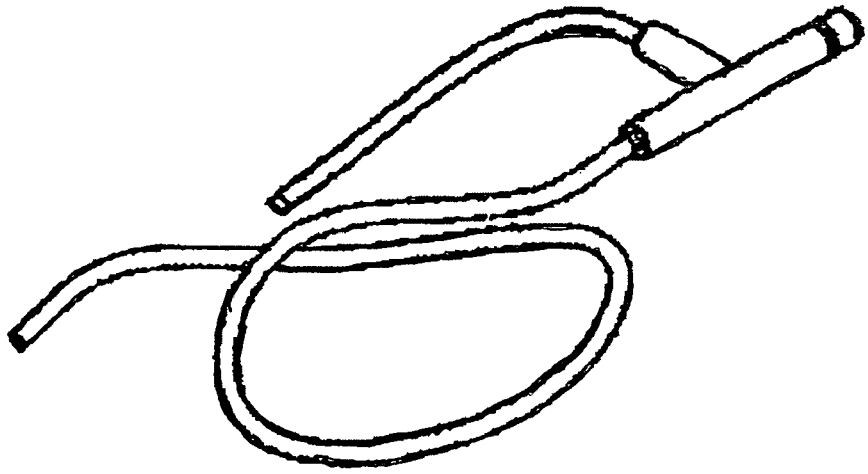
FIG. 3 shows a soap mixing device according to a preferred embodiment of invention.
Figure 4:
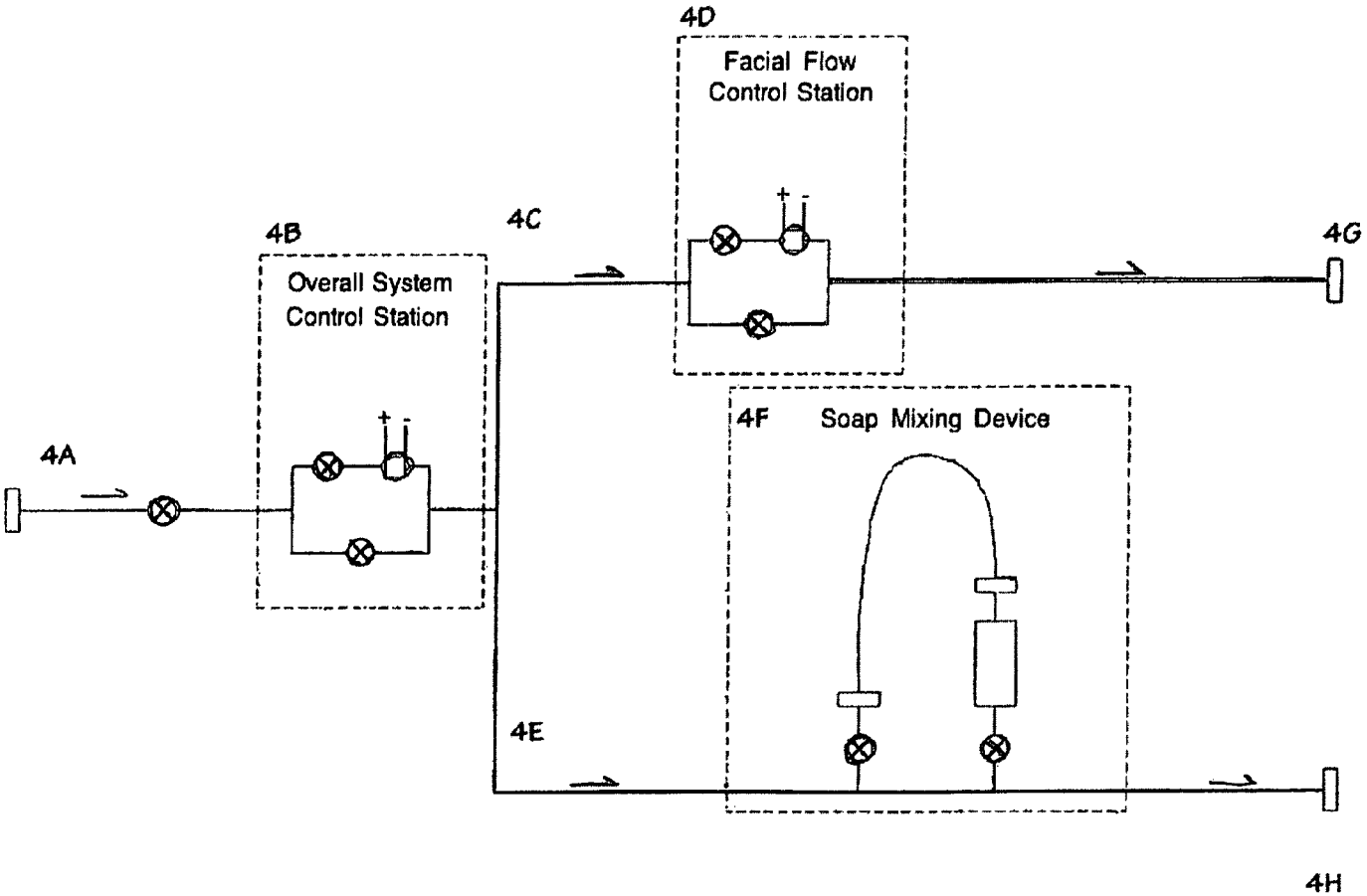
FIG. 4 shows a schematic diagram of the control system and the soap mixing device according to a preferred embodiment of invention.

FIG. 2, illustrates an arrangement in which the soap mixing device is provided with flexible PVC ends 2C, 2H and wherein each PVC end being operably connected to flexible hoses, as shown in FIG. 3. The soap mixing device extracts some water pressure from the corporal water flow via PVC end 2C and mixes it with soap stored in the main soap reservoir. The main soap reservoir is comprised of PVC segments 2B, 2F, 2G and PVC tee 2E. The reservoir has a removable cap 2A, securely attached to the reservoir via PVC male connector 2D; that allows easy refilling. The reservoir has the capacity to store soap for one shower session. Soap mixing device valves (not shown) will be use to regulate the amount of soap solution discharged to the corporal and facial water flows. In FIG. 4, a schematic of the system is shown. The main water flow 4A supplies with water from a bathroom or shower main connection to an overall system control station 4B. The water flow exiting the overall main control system 4B is divided into two parallel flows: facial water flow 4C and corporal water flow 4E. In this embodiment of the invention, the soap mixing device 4F provides the soapy solution only to low pressure shower heads intended for corporal showering. The soap mixing device is selectively connected to the corporal water flow piping system 4E to receive a flow of water which is selectively mixed with soap contained in a transparent soap reservoir, the output of which is selectively reconnected to said corporal water flow piping system 4E in a downstream portion. Two manual valves are selectively provided to control the flow of water into and out of said soap mixing device 4F. The soapy solution leaves the piping system through hose connection end 4H. The facial water flow 4C is operably connected to facial flow control station 4D which provides the user with an independently controlled facial water flow exiting the piping system through hose connection end 4G. Throughout the system, there are provided a plurality of manual valves for adjusting the water flow to the liking of the user. FIG. 6 illustrates integrated showering and body support system of the present invention operably connected by virtue of flexible hose connections 6A, 6B between the main control box 6C and the body support frame 6D. The independent facial and corporal water flows, as discussed in FIG. 4, enter the piping system via flexible hose connections 6A, 6B. As can be appreciated, the water flow running throughout the flexible hose connections 6A, 6B were already treated to as optimal pressure, desired functional low pressure shower heads, addition of soap to water flow and, in some cases, desired water temperature; as regulated by virtue of water temperature sensor (not shown). These particular features are essential to the function and operation of the system.

Figure 5:
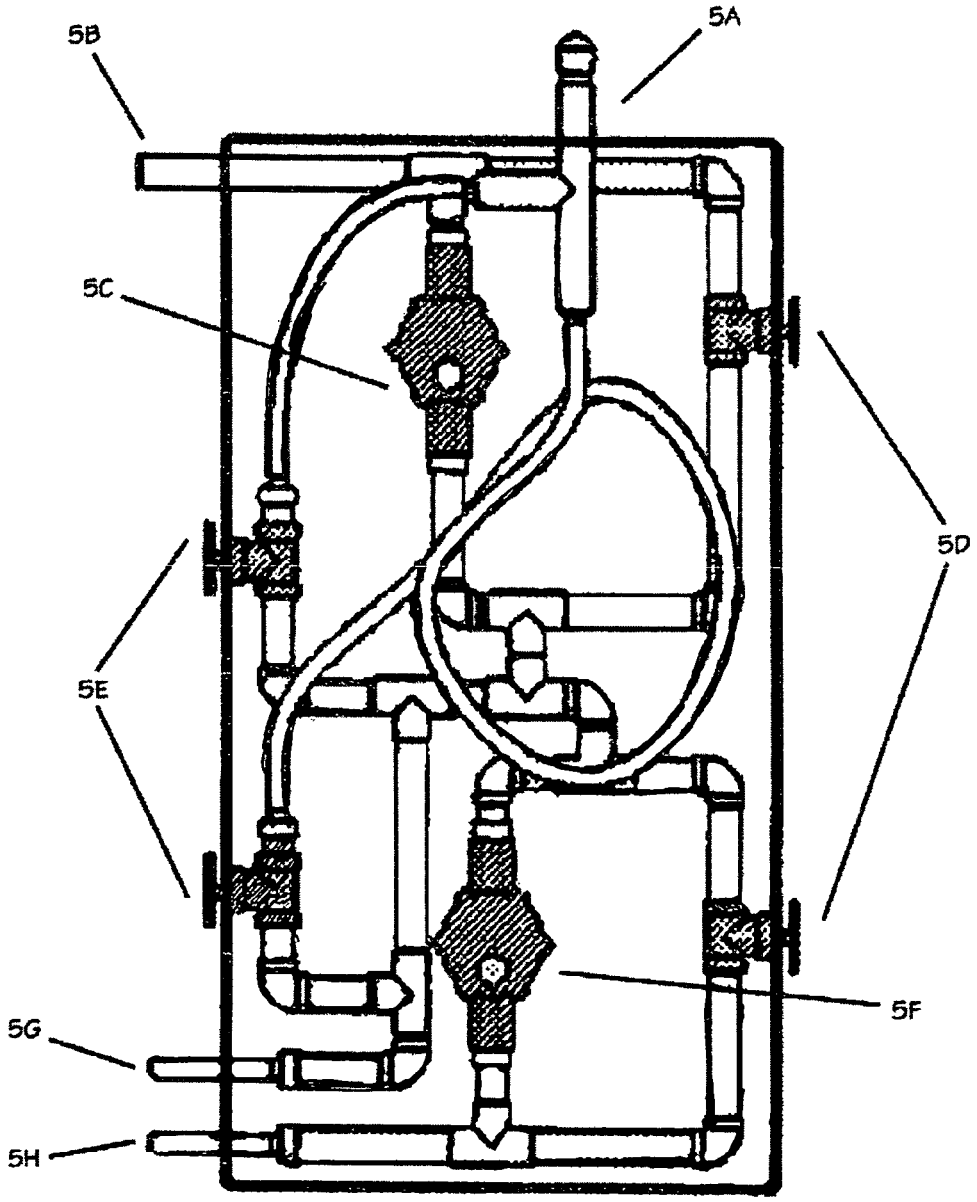
FIG. 5 shows the control system and the soap mixing device according to a preferred embodiment of invention.

Finally, FIG. 5 illustrates a detailed view of the main control feature of the present invention. The main control includes the soap mixing device 5A, as previously discussed in FIGS. 2-3. Main water inlet 5B operably connects the main control feature to an existing water source, such as a shower head or any other type of water faucet. The water flow exists the main control feature via corporal water flow 5G and face water flow 5H. As appreciated from the figure, the user may be provided with a soapy solution from soap mixing device and into corporal water flow 5G. All over the main control feature, main electro-mechanical valves 5C, 5F are disposed to allow wire remote control of the system. These valves 5C, 5F may be integrated to other control sensors (e.g. temperature sensor) to allow people with severe disabilities full control of the system. The electromechanical valves are connected to two 24V AC transformers (not shown) to be plugged to a regular 110V electrical outlet. The transformers are plugged to a universal appliance control system such as but not limited to: Insteon, X10, PLC BUS, KNX (standard), System Box, LonWorks, C-Bus, SCS BUS with OpenWebNet, Universal powerline bus (UPB), UPnP, ZigBee and Z-Wave. The control system may be also provided with two remote modules and a main control box, in this manner the user will be able to activate the electromechanical valves through the main control box. The main control box will regulate remotely the modules in an on/off mode. In one embodiment, electromechanical valves used for irrigation systems may be utilized. This valve will remain close until the required AC voltage is supplied; as a great added feature if the valve fails the system will shut down, allowing in this manner for proper repair maintenance. Manual valves 5E, 5D are provided for easy isolation of localized problems due to malfunction or just for regular maintenance of the system. The control system and soap mixing device will be stored inside a box, as shown in FIG. 6. The box assembly offers a strong structure that will support the control system components (electro-mechanical and manual valves, soap mixing devices and other components) and that it is easily fit inside a bathtub of shower stall due to its dimensions. The preferred box dimensions are 30 inches tall, 36 inches wide and 10 inches deep.

The primary features of the present invention reside in the utility thereof wherein it is easily installed by untrained personnel and usable in various relations and orientations thus providing a disabled person with much needed independence while showering. The foregoing is considered as illustrative only of the principles of the invention. Accordingly, it is intended that the invention shall be limited only to the extent required by the appended claims and rules and principles of applicable law. Further, since numerous modifications and changes will readily occur to those skilled in the art, it is not desired to limit the invention to the exact construction and operation shown and described, and accordingly, all suitable modifications and equivalents may be resorted to, falling within the scope of the invention as claimed.

What is claimed is:

1. An integrated showering and body support system comprising:

a main control unit having a main water supply inlet for receiving a flow of utility water and configured to distribute said flow of utility water into a facial flow piping path and a corporal flow piping path separate and independent from said facial flow piping path, wherein said corporal flow piping path comprises a soap mixing device configured to mix water flowing through said corporal flow piping path with soap and selectively outputting said water mixture into said corporal flow piping path, a main corporal outlet receiving at least one of: the water flowing through said corporal flow piping path and said water mixture, a main facial outlet receiving the water flowing through said facial flow piping path;

a corporal flow piping system removably attached to a body support seat and having a corporal flow inlet configured to receive the output of said main corporal outlet and further comprising a plurality of corporal flow outlets configured to direct the received output of said main corporal outlet to a person's torso and lower body; and a facial water flow piping system removably attached to said body support seat and having a facial water flow inlet configured to receive the output of said main facial outlet and further comprising a facial water flow outlet configured to direct the received output of said main facial outlet to a person's head, wherein said facial water flow piping system is separate and independent from said corporal water flow piping system.

2. The system of claim 1, wherein said main control unit includes a plurality of valves comprising:

a first main valve configured to selectively control the flow of said main water supply inlet;

a second main valve configured to bypass said first main valve and selectively configured to control the flow of said main water supply inlet;

a first facial valve configured to selectively control the flow of water through said facial flow piping path;

a second facial valve configured to bypass said first facial valve and selectively configured to control the flow of water through said facial flow piping path;

a first mixing valve configured to selectively control the flow of water entering said soap mixing device; and a second mixing valve configured to selectively control the flow of said water mixture into said corporal flow piping path.

3. The system of claim 2, wherein at least one of said plurality of valves comprises an electromechanical valve.

4. The system of claim 1, wherein said corporal flow piping system further comprises a corporal flow outlet directed to a genital/perianal area of a person seating in said body support seat.

5. The system of claim 1, wherein said facial water flow outlet comprises a piping section upwardly extending from said body support seat and having an end portion positioned above a person's head so that the received output of said main facial outlet is directed to the top of a person's head.

* * * * *